US005704204A

United States Patent [19]

Mima et al.

[11] Patent Number: 5,704,204

[45] Date of Patent: Jan. 6, 1998

[54] METHOD AND APPARATUS FOR PIECING YARN SLIVERS TO A PARENT YARN IN A YARN SPINNING MACHINE

[75] Inventors: Hiroshi Mima, Jouyou; Yuji Imamura, Kyoto, both of Japan

[73] Assignee: Murata Kikai Kabushiki Kaisha, Ktoto, Japan

[21] Appl. No.: 582,428

[22] Filed: Jan. 3, 1996

[30] Foreign Application Priority Data

Feb. 10, 1995 [JP] Japan ..... 7-046457

[51] Int. Cl.[6] ..... D01H 5/00; D01H 7/46

[52] U.S. Cl. ..... 57/280; 57/261; 57/279; 57/328; 57/333

[58] Field of Search ..... 57/261, 279, 280, 57/333, 328, 350

[56] References Cited

U.S. PATENT DOCUMENTS

| | | | |
|---|---|---|---|
| 4,545,193 | 10/1985 | Tanaka et al. | 57/261 |
| 4,845,936 | 7/1989 | Artzt et al. | 57/261 |
| 4,893,461 | 1/1990 | Artzt et al. | 57/261 |
| 5,263,310 | 11/1993 | Mori | 57/328 |
| 5,511,373 | 4/1996 | Banba | 57/261 |

FOREIGN PATENT DOCUMENTS

| | | | |
|---|---|---|---|
| 3-193922 | 8/1991 | Japan | 57/328 |
| 4-163325 | 6/1992 | Japan | 57/328 |
| 6-173130 | 6/1994 | Japan | 57/328 |
| 6-173132 | 6/1994 | Japan | 57/261 |
| 6-220728 | 8/1994 | Japan | 57/261 |
| 6-220729 | 8/1994 | Japan | 57/261 |

*Primary Examiner*—William Stryjewski

*Attorney, Agent, or Firm*—Armstrong, Westerman, Hattori, McLeland & Naughton

[57] ABSTRACT

This invention is related to a yarn piecing apparatus of a spinning machine arranged with a holding member (12) that holds the parent yarn (Y') which is inserted in the hollow spindle (6) of the spindle member (5) which is seperated from the nozzle member (2), at a predetermined tension so that it does not rotate due to the rotating air current from the nozzle member. As the parent yarn (Y') inserted in the hollow spindle (6) of the spindle member (5) which is seperated from the nozzle member (2) is held by the holding member, there is no rotation of the parent yarn (Y') by the rotating air current and consequently, fibers can be reliably attached to the parent yarn (Y') and the success rate of yarn piecing can be increased.

5 Claims, 3 Drawing Sheets

METHOD AND APPARATUS FOR PIECING YARN SLIVERS TO A PARENT YARN IN A YARN SPINNING MACHINE

FIELD OF THE INVENTION

This invention is related to a yarn piecing method and apparatus for piecing spun yarn on a spinning machine using a rotating air current, which machine has a spindle member that is seperable from the nozzle member.

BACKGROUND OF THE INVENTION

Previously, on a spinning machine using a rotating air current and having a spindle member when a spun yarn was cut and seperable from the nozzle member, the spindle member seperated from the nozzle member and, subsequently, the end of the spun yarn wound from the winding side package or the end of the yarn wound on a specially prepared package (simply a "parent yarn" below) is inserted through the hollow spindle of the spindle member, the nozzle member and spindle member are united, then driving of the spinning machine restarts and fiber supplied from the draft apparatus is attached onto the end of the parent yarn and yarn piecing is carried out.

On a yarn piecing apparatus of a spinning machine of the prior art, as described above, the parent yarn, which is inserted into the hollow spindle of the spindle member and then drawn out from the end of the hollow spindle, is not held in a fixed position and consequently rotates due to the rotating air current generated in the nozzle member in association with the restarting of the spinning machine. Accordingly, a fiber that is supplied from the front roller is not attached to the parent yarn or forms a loop and the end of the fiber is therefore not inserted into the hollow spindle etc. Thus the yarn piecing fails, the joined part is weak and yarn breakage recurs.

SUMMARY OF THE INVENTION

It is a primary object of the present invention to provide a yarn piecing method and apparatus of a spinning machine that not only solves the above mentioned problems concerned with a spinning machine of the prior art, but also produces a yarn joined with a good structure.

In order to achieve the above object, the present invention utilizes a holding member that holds the parent yarn, which is inserted into the hollow spindle of the spindle member seperated from the nozzle member, by a predetermined tension in such a way that it is not rotated by the rotating air current from the nozzle. The aforementioned holding member may be a suction pipe and, furthermore, the parent yarn inserted into the hollow spindle of the aforementioned spindle member is offset from the axis of the nozzle and spindle members and held in a curve in the holding member when the spindle member and the nozzle member are coupled.

DETAILED DESCRIPTION OF THE PREFERRED EMBODIMENT

Figure 1:
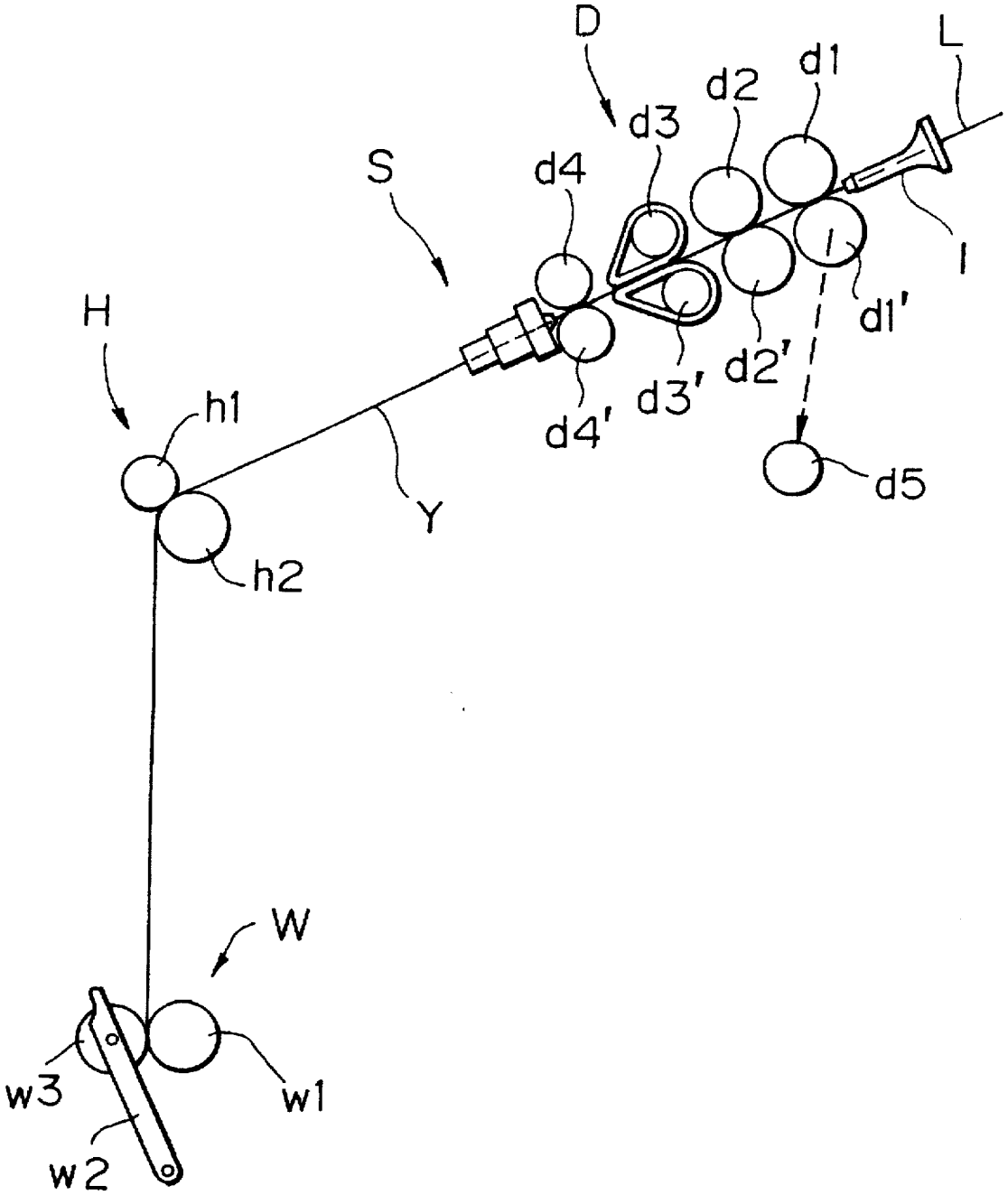
FIG. 1 is a simplified side elevation view of a spinning machine.

Firstly, using FIG. 1, one example applicable to the yarn piecing method and apparatus of the spinning machine of the present invention will be explained.

(L) is a sliver which passes via the sliver guide (1) and is supplied to the draft apparatus (D). The draft apparatus (D) comprises the back roller (d1), third roller (d2), second roller (d3), which has an apron, and the front roller (d4). The sliver (L), which is drafted by the draft apparatus (D), is supplied to the spinning unit (S) which is formed from the nozzle member having air blowing holes that generate a rotating air current and, the spindle member that is seperable from the nozzle member, and after the yarn (Y) has been constructed by the spinning unit (S), the yarn (Y) passes through the yarn-pulling apparatus (H) formed from the removable nip roller (h1) and delivery roller (h2), and is wound onto winding package (w3), which is supported by the cradle arm (w2) and is driven by the friction roller (w1) of the winding part (W). Furthermore, (d1') , (d2'), (d3') and (d4') are the bottom rollers of back roller (d1), third roller (d2), second roller (d3) having an apron, and front roller (d4) respectively.

Also, (d5) is a clutch apparatus comprising a magnetic clutch, or the like for stopping and driving the back roller (d1).

Next, using FIGS. 1–3, the yarn piecing procedure will be explained.

When the yarn (Y) is determined by an appropriate yarn breakage detector (not shown in the drawing) to be cut, the drive of the entire draft apparatus (D) stops due to the clutch apparatus (d5) cutting off and the drive of the back roller (d1) stopping. The supply of sliver (L) is stopped and after that, as shown in FIG. 2, the cylinder (9) is operated and the spindle member (5) that is attached to the support member (11) on the end of the rod (10), (10') seperates from the nozzle member (2).

Also, together with the stopping of the draft apparatus (D), the nip roller (h1) seperates from the delivery roller (h2) and the pulling of the yarn (Y) by the yarn pulling apparatus (H) stops. Furthermore, the winding package (w3) seperates from the friction roller (w1) and the rotation of the winding package (w3) stops.

Numeral (3) identifies the air blowing holes of the nozzle (4) for generating a rotating air current and is bored into the nozzle member (2). The holes (3) are connected to a suitable compressed air supply source (not shown in the drawing).

Figure 2:
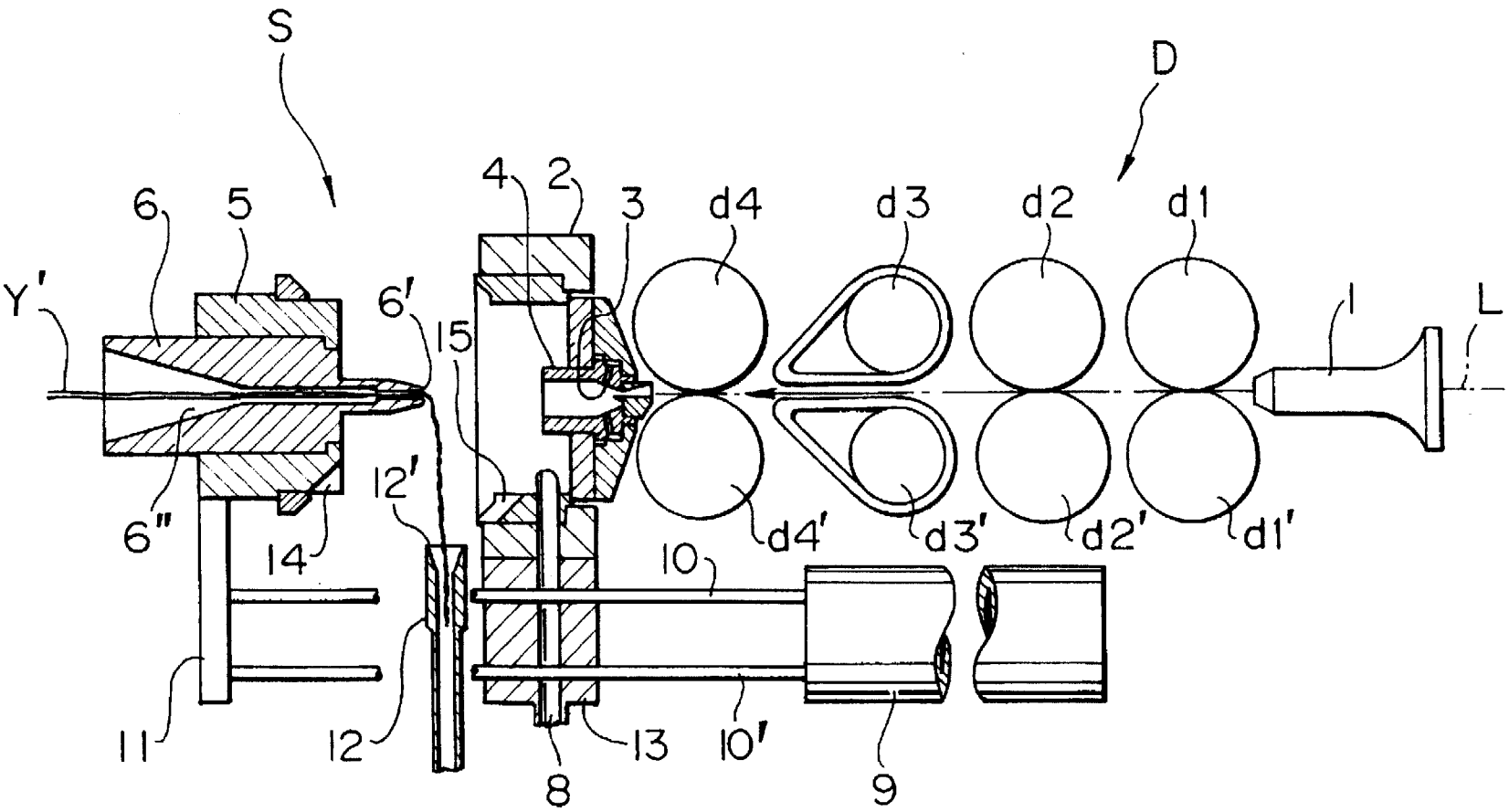
FIG. 2 is a side elevation view of the spinning unit, etc including a vertical section along the central axis of the spinning unit illustrating the spindle member and the nozzle members in a separated condition.

Next, due to a reverse rotation of the winding package (w3), the yarn (Y) is unwound from the winding package and the unwound yarn is inserted in the hollow passage (6"), of the hollow spindle member (6) as shown in FIG. 2, as a parent yarn (Y') and, normally, a predetermined length of the parent yarn (Y') is pulled from the end of the spindle (6). Furthermore, when necessary, the end part of the parent yarn (Y') can be opened in order to make easy attachment of fibers on the parent yarn (Y').

Figure 3:
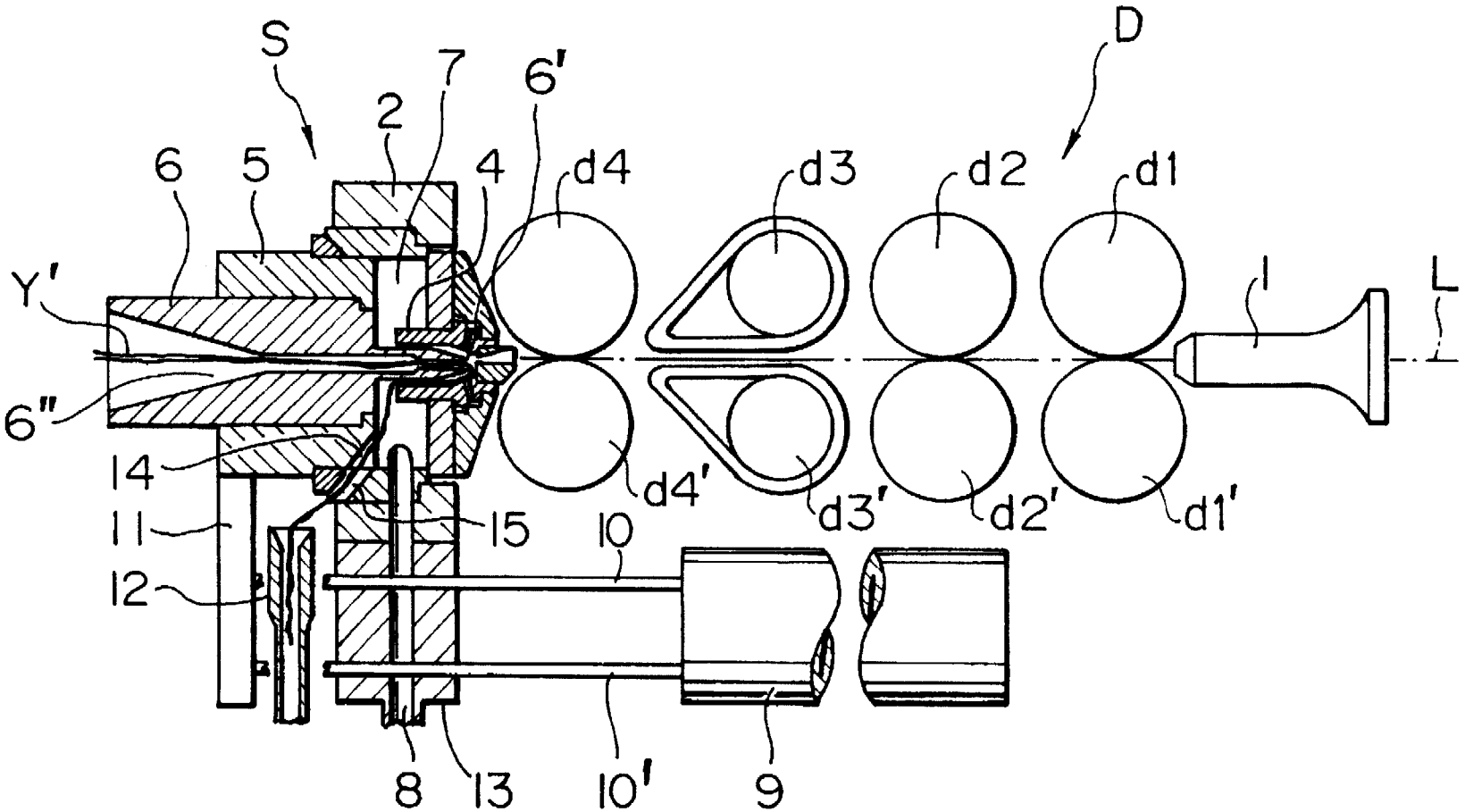
FIG. 3 is a side elevation view similar to FIG. 2 illustrating the spindle member and the nozzle member in a united condition.

In continuance, the cylinder (9) is driven and the seperated spindle member (5) and the nozzle member (2) are brought together, as shown in FIG. 3. After that, due to the clutch apparatus (d5) being driven and the back roller (d1) being rotated, the draft apparatus (D) is driven and supply of the sliver (L) is restarted.

Numeral (8) identifies the suction hole for providing a slight negative air pressure in air chamber (7) during spinning of the yarn (Y). Due to the air chamber (7) being maintained in a slight negative air pressure state, the harmful free fibers that are generated inside the air chamber (7) can be ejected via the suction hole (8).

As described above, after the yarn-piecing operation, the seperated nip roller (h1) is placed in contact with the delivery roller (h2) and, when pulling of the parent yarn (Y') is carried out, immediately before the fibers comprising the sliver (L) reach the parent yarn (Y') which is inserted in the spindle member (5) and yarn piecing is carried out, the seperated nip roller (h1) is contacted with the delivery roller (h2) and, at the same time or immediately after parent yarn (Y') pulling is carried out, the winding package (w3) is contacted with the friction roller (w1) and the winding package (w3) is rotated. Winding of the yarn (Y) is then restarted and one series of yarn piecing operations is complete.

Also, it is possible that, when the pulling of the parent yarn (Y') by the winding package (w3) is carried out in a state where the nip roller (h1) is seperated from the delivery roller (h2), the winding package (w3) contacts the friction roller (w1) and rotates a predetermined amount of time before the fiber comprised of the sliver (L), which has started to be resupplied by the movement of the draft apparatus (D), has reached the parent yarn (Y') inserted in the spindle member (5). Immediately after yarn piecing has been completed, the seperated nip roller (h1) contacts the delivery roller (h2) and the pulling of the yarn (Y) is restarted. Thus one series of yarn piecing operations is complete.

Numeral (12) identifies the suction pipe which is arranged on the travelling yarn piecing apparatus running along the spinning machine. The suction pipe (12) is connected to an air suction source (not shown in the drawing). The suction pipe (12) functions in such a way that when yarn piecing is carried out, it sucks the parent yarn (Y') which is inserted into the hollow spindle (6) of the spindle member (5), that has been separated from the nozzle member (2), and has been pulled from the end part (6') of the hollow spindle (6) and holds the present yarn at an appropriate tension.

In the present embodiment, the suction pipe (12) is arranged so that the end part (12') of the suction pipe is positioned below the end part (6') of the hollow spindle (6). However, in order to place the parent yarn (Y') which has been pulled from the end part (6') of the hollow spindle (6), in a position where it can be sucked, the suction pipe (12) can be positioned anywhere. Further, numeral (13) identifies the support block into which is bored the aforementioned suction holes (8).

Numeral (14) identifies the slit formed in the side wall of the spindle member (5). Numeral (15) is the slit formed in the side wall of the nozzle member (2) and is opposite the slit (14) of the spindle member (5). These two slits (14),(15) are arranged so that, when the spindle member (5) is coupled with the nozzle member (2), the parent yarn (Y'), which hangs down from the end part (6') of the hollow spindle (6) and is held by the suction pipe (12), is not gripped by the side walls of the nozzle member (2) and the spindle member (5).

As shown in FIG. 2, the parent yarn (Y') which is inserted into the hollow spindle (6) of the spindle member (5) that is seperated from the nozzle member (2) and which hangs by a predetermined length from the end part (6') of the hollow spindle (6), is sucked into the suction pipe (12) and is held at a predetermined tension. Next, due to the cylinder (9) and the piston rods (10), (10') moving in the left direction as seen in FIG. 2, the nozzle member (2) and the spindle member (5) are coupled as shown in FIG. 3.

After that, air is blown from the air blowing holes (3) of the nozzle (4) and, as well as a rotating air current being generated in the direction of the end part (6') of the hollow spindle (6), the sliver (L) is supplied to the draft apparatus (D), fibers comprising the sliver (L) are attached to the parent yarn (Y') and yarn piecing is carried out. At this time, on the present invention, as the parent yarn (Y') is sucked into the suction pipe (12), there is no rotation of the parent yarn due to the aforementioned rotating air current and it is maintained in a substantially fixed position. Therefore, fiber comprising the sliver (L) can be reliably attached to the parent yarn (Y') and failure-free yarn piecing can be carried out.

Also, as shown in FIG. 3, when the spindle member (5) and the nozzle member (2) are coupled, due to the fact that the parent yarn (Y') that is inserted in the hollow spindle (6) of the spindle member (5) bends and is held in the suction pipe (12), the movement of the parent yarn (Y') due to the rotating air current can be further restricted and furthermore, the success rate of yarn piecing can be increased.

In addition, as the parent yarn (Y') that is inserted into the hollow spindle (6) of the spindle member (5) curves from the end part (6') of the hollow spindle (6) and follows the outer circumference of the hollow spindle (6), the parent yarn (Y') can be positioned approximately in the flowing direction of the fiber. Therefore, the attachment of the fibers to the parent yarn (Y') can be carried out more reliably.

In place of the aforementioned suction pipe (12), two plate shaped tension washers can be arranged and, due to the parent yarn (Y') being nipped by the tension washers, the parent yarn (Y') hanging from the end part (6') of the hollow spindle (6) can be held. For the parent yarn (Y') to be held at a predetermined tension, various holding devices such as a tension gate, and the like, can be employed and not only a suction pipe (12) or tension washer.

Furthermore, in the above embodiment, the length of the parent yarn (Y') hanging from the end part (6') of the spindle (6) needs to be of a length so that at least the end of the parent yarn (Y') is in a position to undergo the suction effects of the suction pipe (12) or, preferably, be inside the suction pipe (12).

Also, the air pressure that causes the generation of the suction force of the aforementioned suction pipe (12) should preferably be an air pressure that does not pull the parent yarn (Y') from the suction pipe (12) due to the rotating air current which is blown from the air blowing holes (3). In short, it should be a suction pressure. Depending on the type of yarn or other conditions, there are cases when the air pressure of the suction pipe (12) is higher or lower than the air pressure supplied to the air blowing holes 3. In either case, when yarn piecing is carried out, a tension is applied to the aforementioned parent yarn (Y') and in a state with no slack, it is necessary to pull the yarn from the suction pipe (12) due to the start of yarn running by the aforementioned nip roller (h1).

In addition, in place of the aforementioned suction pipe (12), a tension can be applied to the parent yarn (Y') even by a mechanical clamp means. In this case, the above mentioned clamp means is controlled so as to be released before or at the same time as the starting of the yarn running by the aforementioned nip roller (h1).

Furthermore, while the end part of the the parent yarn (Y') is being held by the aforementioned suction pipe (12), the fibers on the surface of that yarn become fuzzy due to the contact with the inside wall of the suction pipe (12). When yarn piecing occurs, the parent yarn (Y') easily entangles in the sliver (L) supplied from the draft apparatus (D) thus supplementing or increasing the effectiveness of the yarn piecing actions.

The present invention demonstrates the effectiveness, as described, below due to the construction mentioned above.

As the parent yarn inserted in the hollow spindle of the spindle member which is seperated from the nozzle member, is held by the holding member, there is no rotation of the parent yarn by the rotating air current and consequently, fibers can be reliably attached to the parent yarn and the success rate of yarn piecing can be increased.

When the spindle member is coupled with the nozzle member, the movement of the parent yarn from the rotating air current can be farther restricted due to the parent yarn being held in a curve which further increases the the yarn piecing success rate.

What is claimed is:

1. A method for piecing a supply of slivers to a yarn in a spinning machine having a nozzle member separable from a spindle member, each of said members containing passages disposed on substantially mutually aligned axes, and means in said nozzle member for generating a rotating current of compressed air, said method comprising:

separating said nozzle member from said spindle member;

supplying a parent yarn through said passage in said spindle member to a position intermediate said spindle member and said nozzle member whereat an end of said parent yarn is offset from said axes of said nozzle member and said spindle member;

bringing said nozzle member and said spindle member together;

imposing a predetermined tension on said parent yarn sufficient to prevent its being rotated by said rotating current of compressed air; and thereafter, initiating the blowing through the nozzle member of compressed air in rotating currents and the supply of slivers to said parent yarn for piecing said slivers thereto.

2. A method of piecing according to claim 1, in which said predetermined tension is imposed by a suction force applied to said parent yarn.

3. A yarn spinning machine comprising:

a nozzle member and a spindle member each containing passages on substantially mutually aligned axes, means for relatively moving said nozzle member axially with respect to said spindle member, means in said nozzle member for directing rotating currents of compressed air toward said spindle member when said nozzle member and said spindle member are in their respective operative positions for spinning yarn, a suction passage for removing free fibers generated in said spinning machine, and holding means operative to hold a parent yarn inserted through the passage in said spindle member at a predetermined tension sufficient to prevent its being rotated in said nozzle member by said rotating currents.

4. A yarn spinning machine as claimed in claim 3, wherein said holding member is a suction pipe.

5. A yarn spinning machine as claimed in claim 3, wherein said holding member is a mechanical clamping means.

* * * * *